US006623411B2

(12) United States Patent
Terranova

(10) Patent No.: US 6,623,411 B2
(45) Date of Patent: Sep. 23, 2003

(54) BAG-MAKING MACHINE WITH WEB ALIGNMENT CONTROL

(75) Inventor: Peter Terranova, Howard Beach, NY (US)

(73) Assignee: Ro-An Industries Corporation, Middle Village, NY (US)

( * ) Notice: Subject to any disclaimer, the term of this patent is extended or adjusted under 35 U.S.C. 154(b) by 28 days.

(21) Appl. No.: 10/057,023

(22) Filed: Jan. 25, 2002

(65) Prior Publication Data

US 2003/0144120 A1 Jul. 31, 2003

(51) Int. Cl.[7] ..... B31B 1/00
(52) U.S. Cl. ..... 493/13; 493/17; 493/204
(58) Field of Search ..... 443/3, 13, 14, 443/17, 18, 204, 186, 8

(56) References Cited

U.S. PATENT DOCUMENTS

| | | | | | |
|---|---|---|---|---|---|
| 4,699,607 | A | * | 10/1987 | Lambrecht | 493/204 |
| 5,094,656 | A | * | 3/1992 | Hatchell et al. | 493/193 |
| 5,338,281 | A | * | 8/1994 | Terranova | 493/28 |
| 5,667,468 | A | * | 9/1997 | Bandura | 493/475 |
| 6,004,252 | A | * | 12/1999 | Blaser | 493/204 |
| 6,149,565 | A | * | 11/2000 | Meyer et al. | 493/22 |

* cited by examiner

*Primary Examiner*—Eugene Kim
(74) *Attorney, Agent, or Firm*—Steinberg & Raskin, P.C.

(57) ABSTRACT

A plastic bag making machine which includes a web sensor, a push station, a sealing and cutting station, and a wicketer and stacking station has its punch apparatus is carried on a punch carriage movable in a direction transverse to the web feed direction and its conveyor carrier on a conveyor carriage movable in such transverse direction.

14 Claims, 9 Drawing Sheets

BAG-MAKING MACHINE WITH WEB ALIGNMENT CONTROL

FIELD OF THE INVENTION

This invention relates to a method and apparatus for manufacturing plastic bags by transversely cutting and sealing a plastic web at spaced locations, and more particularly to a method and apparatus for improving the efficiency at the stacking station of the bag making machine.

BACKGROUND OF THE INVENTION

Bag making machines of various types are known, as generally exemplified in U.S. Pat. Nos. 5,338,281, 5,094,656 and 4,699,607, which are incorporated herein by reference. As disclosed in these patents certain types of plastic bags are typically manufactured by drawing a tubular plastic web from a supply roll, then punching holes to be inward of one edge of the film, then cutting and sealing the web transversely at a cut and seal station to form bags of selected lengths. The formed bags are then carried by a wicketer vacuum arm assembly to a stacking station where the bags are stacked onto a set of wicketing pins mounted to a wicketing stand which is carried by an intermittently moving conveyor. It is intended that the pre-punched holes in the bags align with the wicketing pins as the bags are delivered to the pins which then extend through the holes. Such alignment does not always occur, leading to damaged bags and jamming of the machine, which is the subject of the present invention. When a desired amount of bags are stacked the full wicketing stand is moved by the conveyor away from that stacking station, and a new wicketing stand including an empty set of wicketing pins moves into position to receive a new supply of formed bags. This procedure is repeated as each wicketing stand is filled and moved away.

Typical prior art bag making machines include various arrangements of the components including a supply roll and unwind station, a synchronizing station, a punch and registration station, a draw-to-length station, a cutting and sealing station, a transfer station and a stacking and delivery station. In such bag making machines the supply roll is either driven by a motor designated driven unwind or pulled by a capstan roller servo motor.

In a continuous feed unwind machine the web's continuous motion is converted into a stop-and-go motion at the synchronizing station. In the "go" portion of the stop-and-go motion the web is pulled by a set of draw rollers driven by a servo motor or by a clutch apparatus to the desired length (draw-to-length section). In the "stop" portion of the stop-and-go motion the cutting and sealing operations are performed. Prior to the cutting and sealing station one or more holes are punched through the web usually near its edge. These holes need to be at a correct distance from the web edge because downstream they must align with and descend onto wicketing pins extending from a wicketing stand carried by an intermittently moving conveyor.

A persistent and inherent problem in such bag making machinery is that as the fast moving web progresses in the web feed direction to the punch station, it periodically shifts, drifts or wanders transversely of said web feed direction. Holes in the web are then punched too close or two far from the edge of the web, and downstream those holes fail to properly align with the wicketing pins. As noted above, the consequences of such misalignment include damaged bags and jamming and interruption of the machine operation.

A technique in the prior art which attempted to solve the above-described problem included provision at the hole punch station of a punch carriage carrying the punch apparatus that is movable transversely of the web feed direction, and provision at the stacking station of a conveyor carriage carrying the wicketing pins that is similarly movable transversely of the web feed direction. The strategy was to monitor with a web sensor the transverse web shift in the vicinity of the hole punch station, determine the amount of this transverse shift and communicate this information to a controller, such as a PLC, which directed a servo motor and gear drive to move the conveyor carriage on which the wicketing pins were mounted, such that the pins would be re-positioned to better align with the holes made in the bags at the punch station. More specifically, the web sensor provided a directional signal which was converted by the controller to a directional output to the conveyor carriage servo motor and its gear drive. This prior art system further included a flexible drive cable connected from the conveyor carriage servo motor back to a gear drive at the hole punch carriage. For each full or partial rotation of this conveyor carriage servo motor and gear drive the flexible drive cable was intended to produce the same rotation in a similar gear drive coupled to the punch carriage, and to produce the same transverse movement in the punch carriage as was occurring with the conveyor carriage.

This prior art arrangement with a flexible drive cable has been found to have various serious drawbacks. At times this cable becomes bent or tangled, causing the hole-punching carriage not to follow the transverse movement of the conveyor carriage, with a continuation of the original problem, namely that plastic bags have holes punched in locations which will not properly align with the wicketing pins at the stacking station.

Another problem with this prior art flexible drive cable occurs when it becomes necessary to intentionally change the location of the hole punching apparatus, to allow the punched holes to be closer to or further from the web edge. In this prior art system this change is accomplished by manually uncoupling the flexible drive cable from the stacking station motor, manually rotating this cable clockwise if the punched holes need to be closer to the edge or rotating the cable manually counterclockwise if the punched holes need to be farther away from the web edge. Machine operators have to estimate how many manual turns of the cable will be needed to position the hole punch carriage in the desired location. After the flexible cable is re-attached manually, the bag-making machine has to be started and then run to produce enough bags to check if the punched holes in the web core at the desired distance. If the adjustment is unsatisfactory this whole sequence of steps has to be repeated multiple times.

OBJECTS AND SUMMARY OF THE INVENTION

A principal object of this invention is to overcome the problem of bags having punched holes which are not properly aligned with stacking pins at the stacking station. Accordingly, it is an object to better control the positioning of the hole punch carriage such that the holes are punched at the desired distance from the web edge. An additional object is to eliminate the flexible drive cable apparatus of the prior art used in an attempt to coordinate the punch station with the stacking station. A still further object is to provide a system for adjusting and controlling the transverse positions of both the hole punch and conveyor carriages instead of merely having the punch carriage attempt to follow the conveyor carriage.

To achieve these objects the invention provides a sensor/transducer and a servo motor for each of the conveyor and punch carriages, along with an appropriate servo controller and a web sensor near the punch station. If the web shifts transversely of the web feed direction, the web sensor outputs a directional signal to the servo controller which directs a servo motor coupled to the conveyor carriage to move similarly transversely. The sensor/transducer coupled to the conveyor carriage registers this movement of the conveyor carriage relative to a reference point and outputs a directional signal to the servo controller which directs the servo motor coupled to the punch carriage to move transversely as the conveyor carriage moved. The sensor/transducer at the punch station detects this movement of the punch carriage relative to a reference point and outputs a directional signal to the servo controller to be compared with the output signal from the conveyor carriage sensor/transducer. The servo controller continues to receive feedback from the two sensor/transducers and to output commands to the two servo motors. When the output signals from both sensor/transducers are the same, alignment and equilibrium will be achieved and the servo controller will cease directional outputs to the two servo motors The invention thus includes a new bag making machine and method as described herein and a subsystem of a punch station and a stacking station with their respective sensor/transducers and servo motors coupled through a servo controller to achieve alignment of the punched holes in cut bags with wicketing pins at the stacking station.

Apparatus embodying the invention will now be described, by way of example only, with reference to the accompanying diagrammatic drawings. These drawings are intended to be illustrative of a preferred embodiment of the invention and are not meant to limit the scope of the invention as encompassed by the claims.

DETAILED DESCRIPTION OF THE PREFERRED EMBODIMENT

Figure 1:
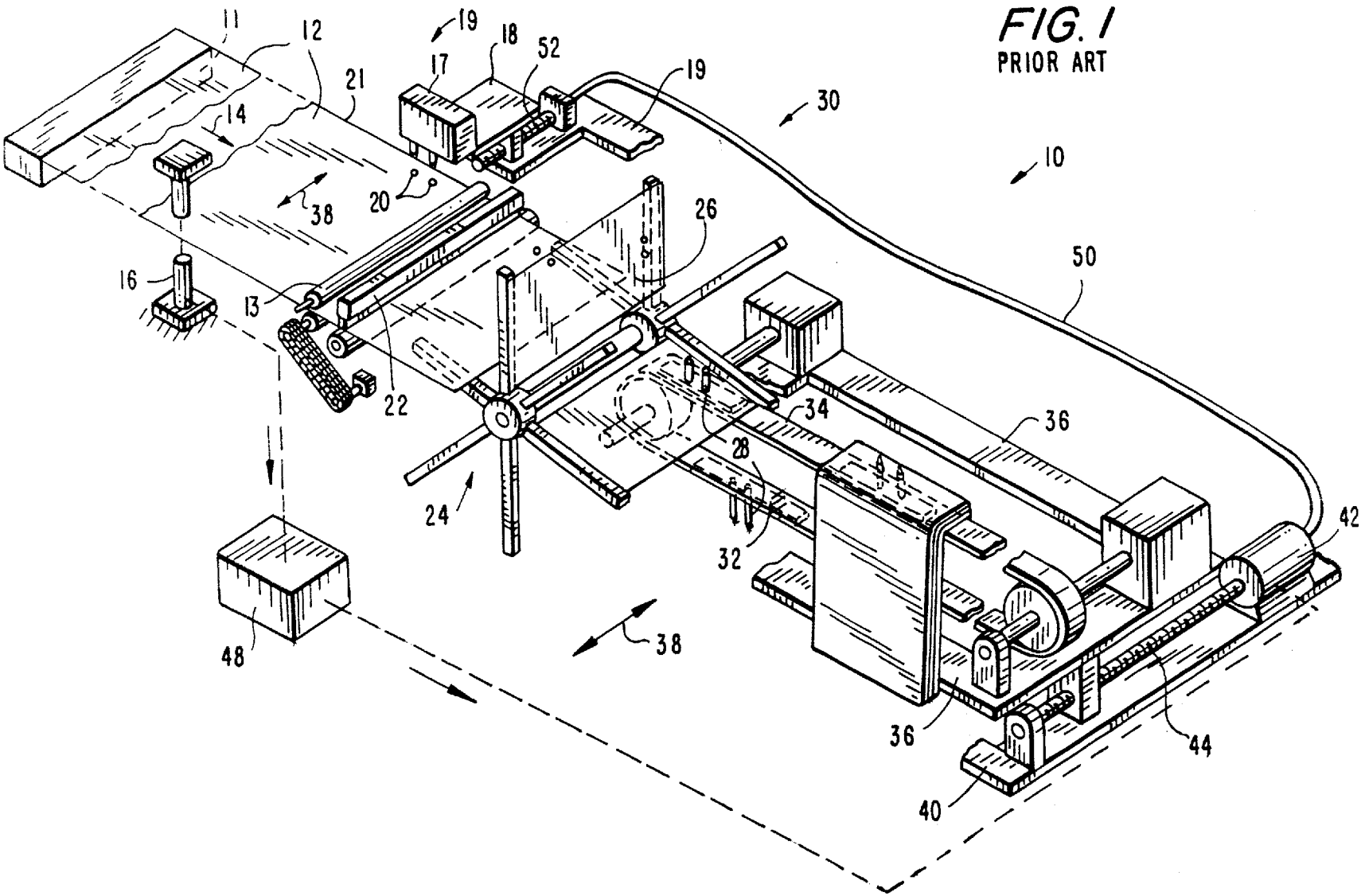
FIG. 1 PRIOR ART
FIG. 1 is a fragmentary schematic perspective view of a prior art bag making machine.

The new invention will be better understood by first reviewing relevant structure in a prior art bag making machine shown schematically in FIG. 1. In this figure the upstream stations of the machine including the supply roll of plastic web formed into a flattened tubular sheath are represented by block 11. Thereafter, this web 12 as drawn by draw rolls 13 moves in the web or downstream direction indicated by arrow 14. This web passes a web sensor 16 and then passes a punch apparatus 17 mounted on a transversely removable punch carriage 18 at a punch station 19 where holes 20 are made near the edge 21 of the web. Next is the heat seal and cutting bar 22 and then a vacuum arm wicketer assembly 24 which deposits formed and cut bags 26 onto wicketing pins 28 at stacking station 30. The wicketing pins extend from wicketing stands 32 mounted at intervals on a conveyor belt 34. The conveyor belt is mounted on a conveyor carriage 36 which is movable transversely in the direction of arrows 38 relative to a stationary base 40. Servo motor 42 and lead screw drive assembly 44 provide this transverse movement as further explained below.

In the prior art it is well known that the fast moving web 12 frequently shifts transversely in the directions indicated by arrow 38 and that this causes the holes 20 to be punched too close or too far from the edge 21 of the web 11 which leads to later misalignment of these holes with the wicketing pins 28 at the downstream stacking station 30.

In the operation of this embodiment of FIG. 1, when a transverse shift of web 12 is detected by web sensor 16 a directional output signal is transmitted to a controller 48 which directs servo motor 42 at the stacking station to rotate lead screw drive assembly 44 which moves conveyor carriage 36 a transverse distance appropriate to compensate for the detected transverse direction shift of the web, with the objective being to transversely move the wicketing pins so they align with holes 20 that were punched out of position due to the prior transverse web shift.

The transverse movement of the conveyor carriage 36 is directly proportional to the number of full or partial turns of the lead screw in drive assembly 44. In this prior art bag making machine it is an objective to coordinate the transverse position of the punch carriage 18 and its punch apparatus 17 with the transversely moved conveyor carriage 36, and thus to move the punch carriage 18 transversely essentially the same amount as the conveyor carriage 36 by use of a flexible drive cable 50 extending from the lead screw drive assembly 44 for the conveyor carriage to a similar lead screw drive assembly 52 for the punch carriage 18. This drive cable 50 transmits the same amount of rotation it receives from drive assembly 44 back to the lead screw drive assembly 52 for the punch carriage, attempting to achieve the same transverse movement. This procedure of the web sensor signal causing the conveyor and punch carriages to be moved transversely is continuously repeated in the attempt to compensate and attain acceptable alignment of the punched holes in cut bags with the wicketing pins at the stacking station. This flexible drive cable arrangement has a number of serious drawbacks described above, which have led to the present invention.

Figure 2:
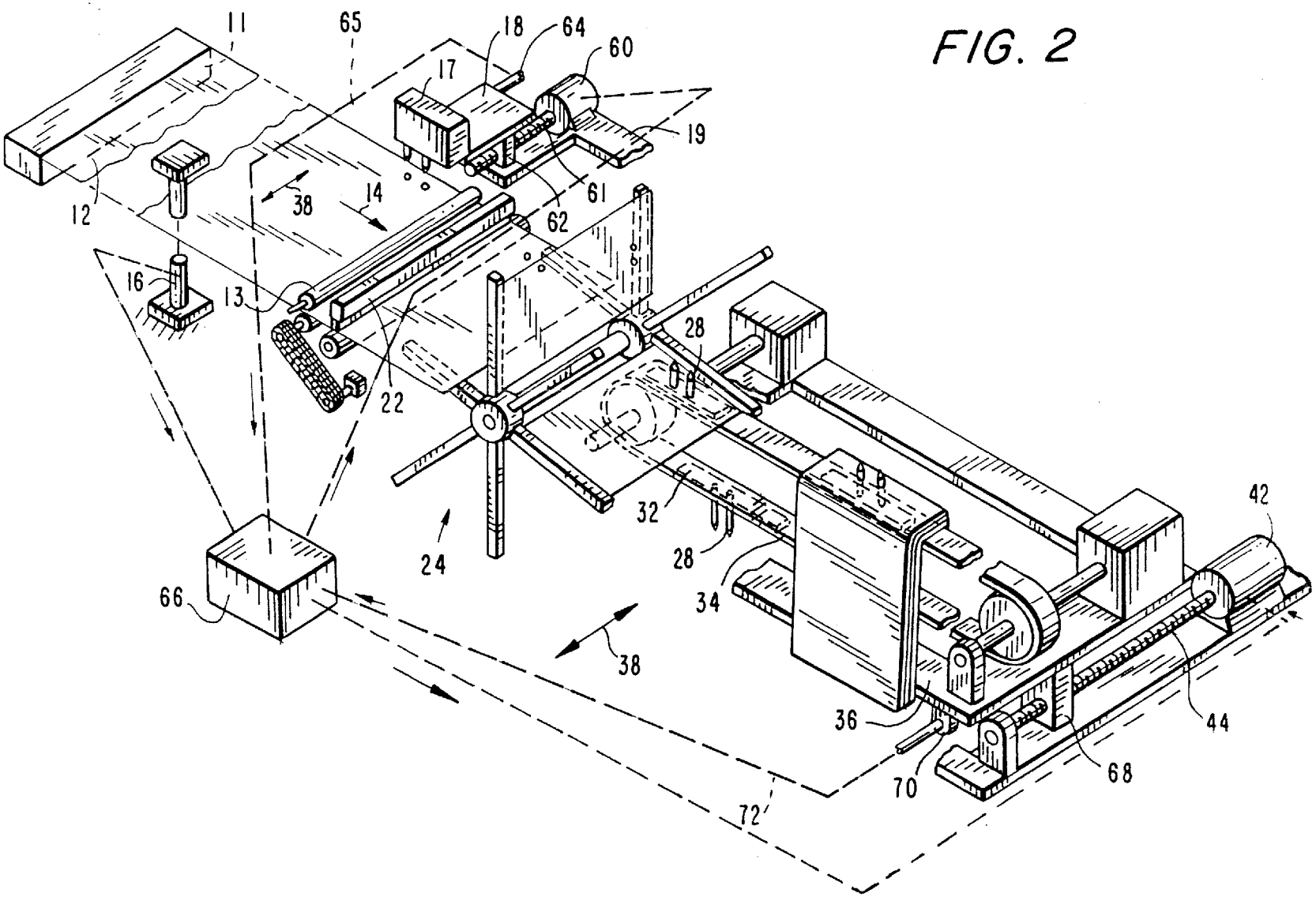
FIG. 2 is a fragmentary schematic perspective view of a bag making machine according to the present invention.
Figure 3:
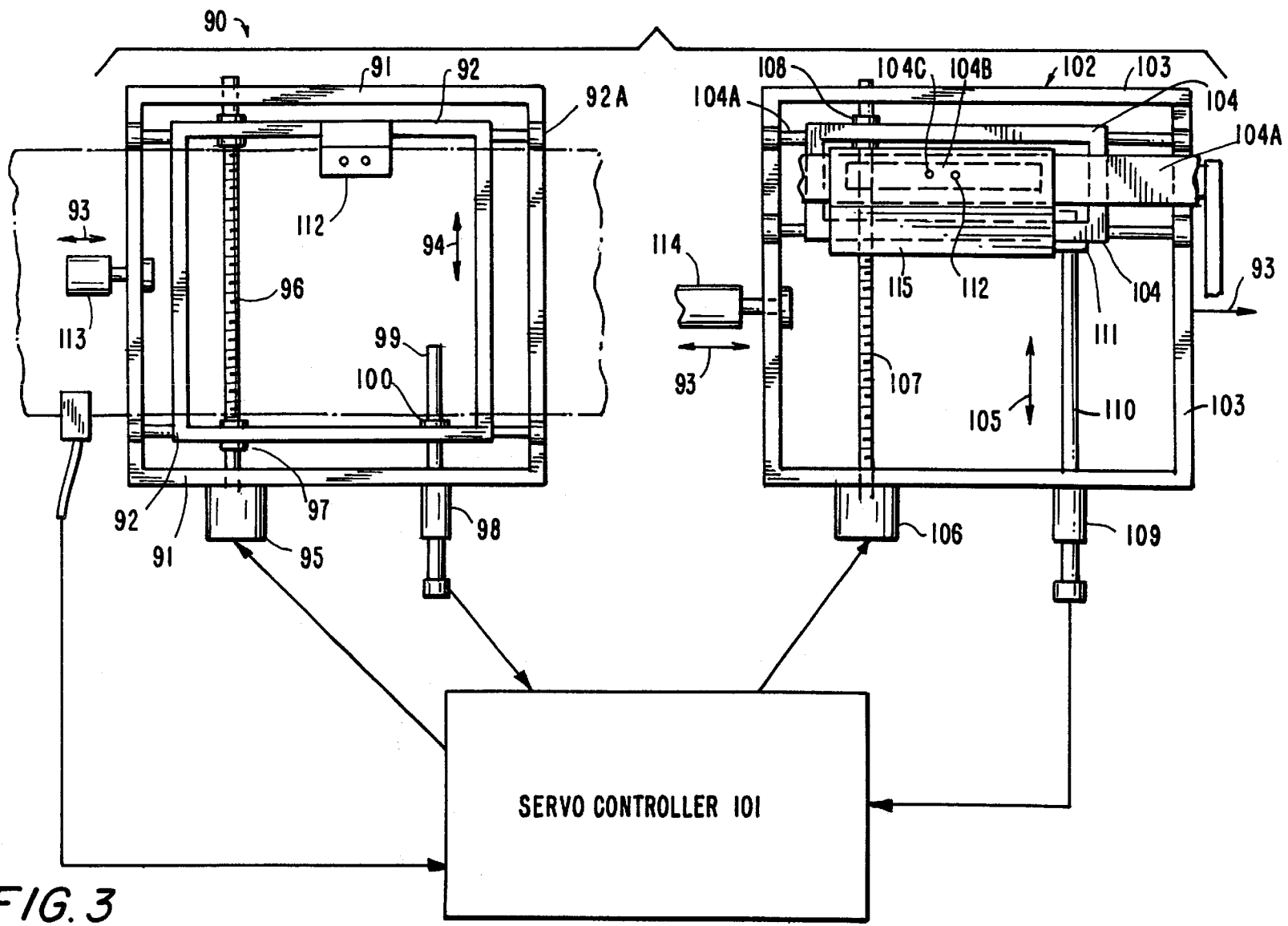
FIG. 3 is a fragmentary top plan schematic view of a second embodiment of the new bag making machine, but showing only the punch and stacking stations and the web sensor and servo controller.

The new bag making machine is first shown schematically in FIG. 2. FIG. 3 shows schematically a second embodiment of the new bag making machine, but illustrates in detail only the punch and conveyor assemblies of the machine of FIG. 2. FIGS. 4–9 show the punch and conveyor carriage assemblies of the bag making machine represented by FIG. 3. For convenience, only the portions of the bag making machine which are relevant to this invention are included in these figures, with components not shown being well known in the prior art. Component parts of the new invention in FIG. 2 which are the same as or correspond to component parts in the prior art machine of FIG. 1 have like reference numbers for clarity and ease of description. FIGS. 4–9 will have a separate set of reference numbers.

Accordingly, in FIG. 2, looking from left to right, the prior art components include the upstream sections represented by block 11, the moving web 12, the web sensor 16, the draw rolls 13, the punch apparatus 17, the transversely moveable punch carriage 18 on a stationary punch base 19, the sealing and cutting apparatus 22, the wicketer vacuum arm assembly 24, the conveyor assembly including the conveyor's stationary base 40, a transversely movable conveyor carriage 36, the conveyor belt 34, the wicketing pins 28 on wicketing stands 32, and lead screw motor drive assembly 42, 44 for the conveyor carriage. In a preferred embodiment the punch base 19 and the conveyor base 40 would be formed as a single frame element of the bag making machine.

The new invention of FIG. 2 is structurally and functionally different from the prior art machine of FIG. 1 as follows. In the new system, the punch carriage and the conveyor carriage are now each coupled to a servo motor to provide transverse movement, and each is coupled to a sensor/transducer to detect the amount of such transverse movement and indicate same by proportional voltage outputs to a servo controller.

More specifically in FIG. 2, coupled between punch carriage 18 and punch base 19 is servo motor 60 which rotates lead screw 61 which drives drive nut 62 fixed to punch carriage 18, thus moving punch carriage 18 transversely. Also coupled to the punch carriage is a sensor/transducer 64 which detects changes in the transverse position of the punch carriage and outputs, as indicated by line 65, a voltage proportional to such movement to servo controller 66.

Coupled between conveyor carriage 36 and conveyor base 40 is servo motor 42 which rotates lead screw 44 which drives drive nut 68 fixed to conveyor carriage 36, thus moving the conveyor carriage transversely. Also coupled to the conveyor carriage is a sensor/transducer 70 which detects changes in the transverse position of the conveyor carriage and outputs, as indicated by dashed lines 72, a voltage proportionate to such movement to servo controller 66. As before, the web sensor 16 outputs its signal to the servo controller whenever the web drifts transversely out of pre-established allowed movement limits.

In the operation of this new system the servo controller 66, in response to the signal from the web sensor 16, directs servo motor 42 to start moving the conveyor carriage transversely to compensate for the transverse web shift that has occurred. Conveyor carriage sensor/transducer 70 detects the transverse movement of the conveyor carriage as it occurs and produces a proportional voltage output to the servo controller which directs the punch carriage servo motor 60 to begin moving the punch carriage to attain the same transversely displaced position as attained by the conveyor carriage. As transverse movement of the punch carriage occurs, its sensor/transducer 64 detects and reports via its proportional voltage output to the servo controller which in turn refines its direction to the conveyor carriage servo motor. This sequence is repeated until the voltage outputs from the two sensor/transducers are equal or similar within pre-described ranges, at which time the servo controller ceases sending commands to the servo motors. This new system continuously adjusts the transverse positioning of the punch carriage and of the conveyor carriage so that hole alignment with the wicketing pins is at all times as accurate as possible.

FIG. 3 illustrates a second embodiment of the new bag making machine, but shows only the components most relevant to the present invention which correspond particularly to the punch and conveyor carriages of FIG. 2. Accordingly, in FIG. 3 there is at punch station 90 a punch carriage assembly which includes a punch base 91 appearing as a stationary outer frame and a transversely movable punch carriage 92 appearing as inner frame 92, which correspond respectively to the punch carriage base and punch carriage in FIG. 2. Also in FIG. 3 there is at the stacking station 102 a conveyor carriage assembly which includes a conveyor base 103 appearing as an outer frame and a conveyor carriage 104 appearing as an inner frame corresponding respectively to the conveyor base and the conveyor carriage in FIG. 2.

Punch carriage 92 carries hole punching apparatus 112 which is positionally adjustable in the transverse direction of arrow 94 via roller bearing assembly 92A. This punch carriage is moved by servo motor 95 mounted to base 91 which is coupled to a lead screw drive assembly including lead screw 96 and drive nut 97 mounted to the punch carriage 92. Punch carriage 92 is also adjustable in the web feed direction per arrow 93 by an adjustment device 113.

A sensor/transducer 98 mounted to base 91 has its central shaft 99 extending through ring magnet 100 mounted on punch carriage 92. The amount of transverse movement of punch carriage 92 is measured by sensor/transducer 98 which outputs a directional signal proportional to said amount of movement to servo controller 101.

FIG. 3 further illustrates at stacking station 102 conveyor carriage 104 which is movable transversely in the directions of arrow 105 relative to stationary base 103 via roller bearing assembly 104A. Mounted on the conveyor carriage 104 is conveyor belt assembly 104A which carries wicketing pin stands 104B from which extend wicketing pins 104C. Similarly to the punch station arrangement, conveyor carriage base 103 has mounted thereto a servo motor 106 which drives lead screw 107 coupled to drive nut 108 mounted to conveyor carriage 104. Also, similarly to the punch station, there is a sensor/transducer 109 mounted to base 103 and a shaft 110 which extends through ring magnet 111 mounted to conveyor carriage 104. Sensor/transducer 109 measures transverse movement of conveyor carriage 104 and outputs a voltage signal proportional to the amount of transverse movement of carriage 104 to servo controller 101. It is optional to mount the sensor/transducers on the stationary bases and to mount the ring magnets on the movable carriages or vice versa. Also, it is optional to mount the servo motors on the stationary bases and to mount the lead screw drive nuts on the movable carriages or vice versa. Further shown at stacking station in FIG. 3 are wicketing pins 104C onto which holes 112 of the formed bags 115 descend, and adjustment device or drive means 114 to move the conveyor carriage in the web feed direction per arrow 93.

Figure 4:
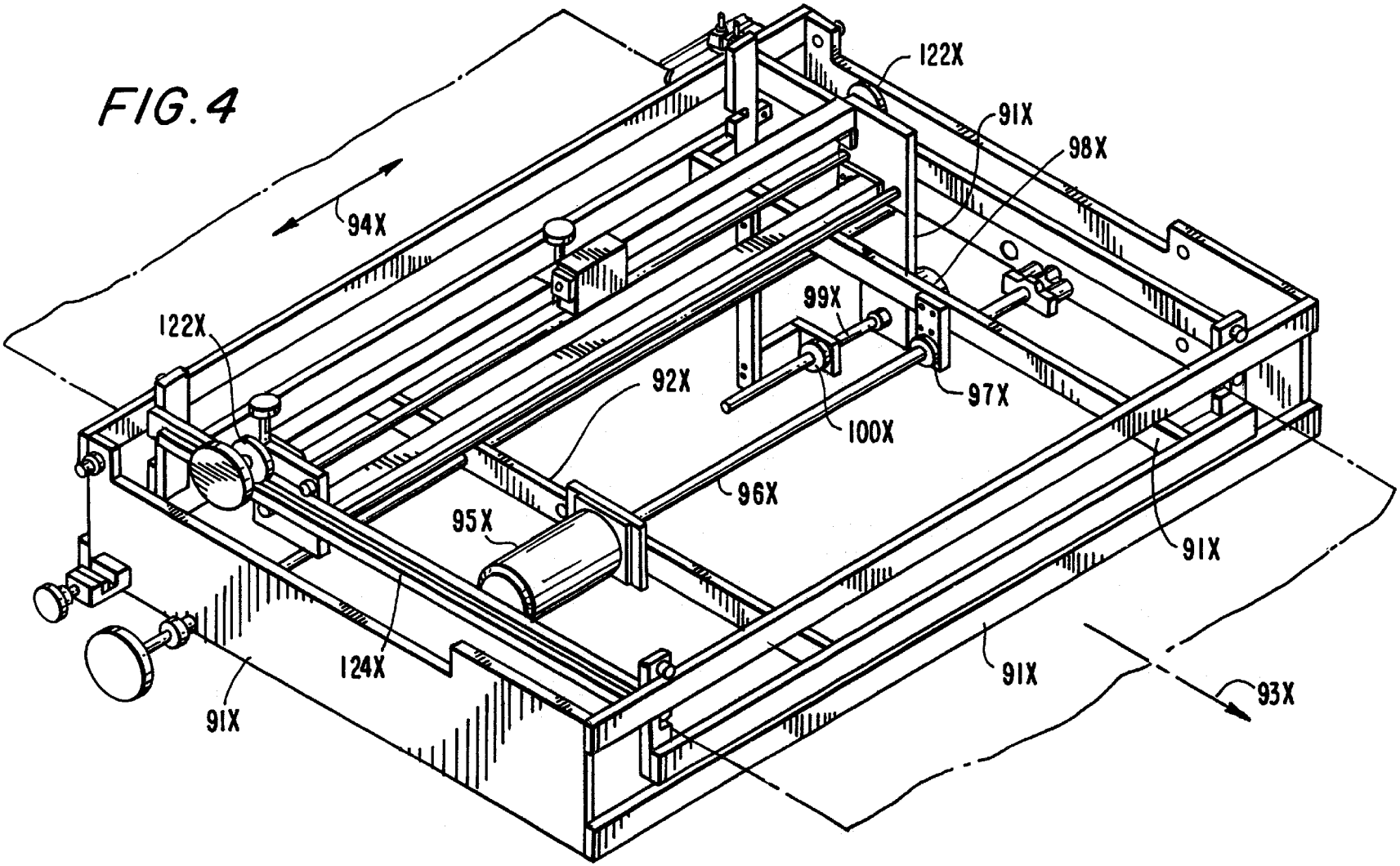
FIG. 4 is a top perspective view of the punch station apparatus of a third embodiment of the bag making machine of FIG. 3.
Figure 5:
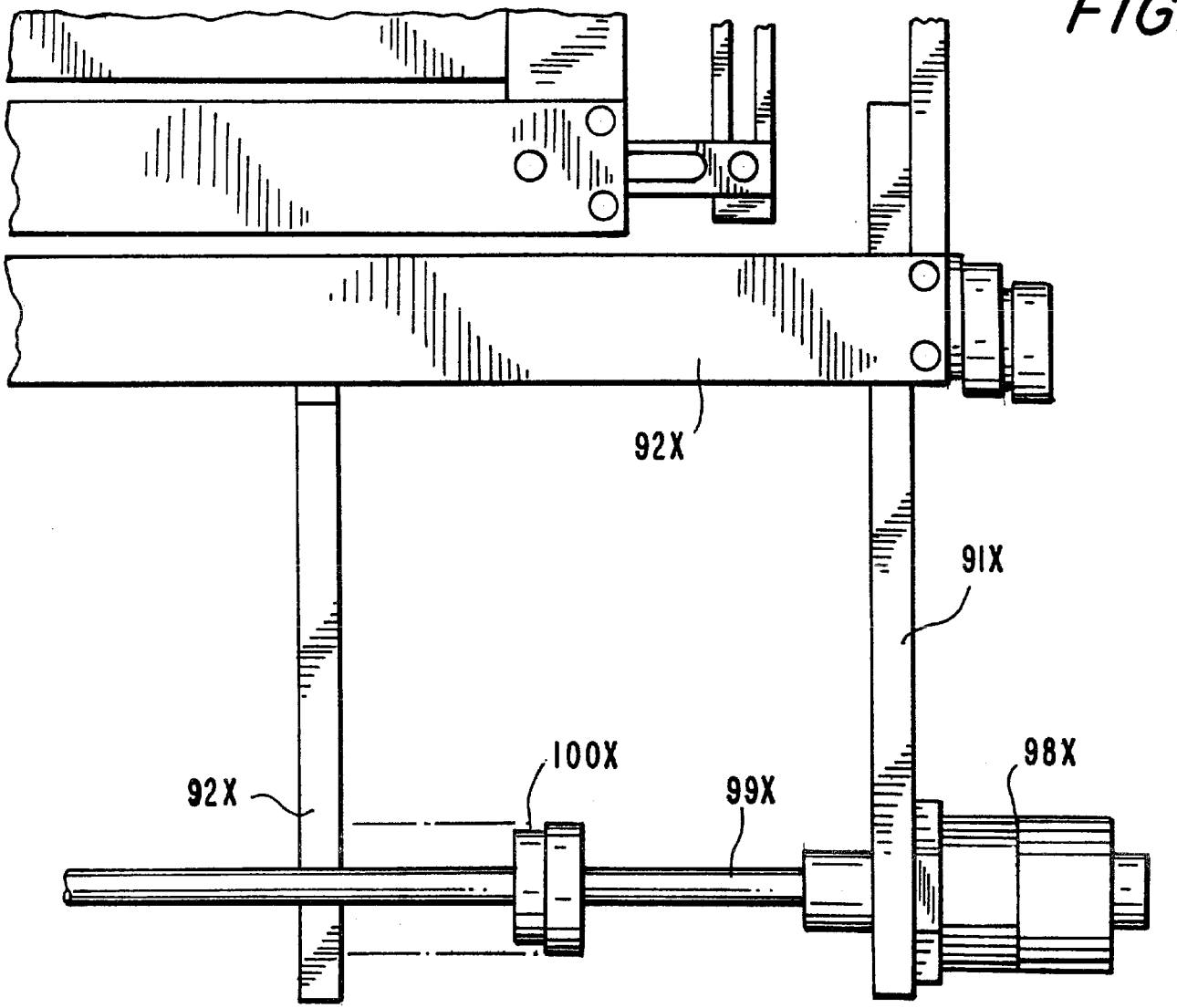
FIG. 5 is a fragmentary side elevation view of the apparatus shown in FIG. 4.

FIGS. 4–7 illustrate detailed structure of the punch and conveyor carriage assemblies shown schematically in FIG. 3, where elements in these figures which correspond to the same elements in FIG. 3 are given the same reference designations followed by the suffix "X". Accordingly, in FIGS. 4–7, there is a stationary punch base 91X and movable punch carriage 92X. FIGS. 4 and 5 further include sensor/transducer 98X and its shaft 99X mounted to punch base 91X, and ring magnet 100X mounted to punch carriage 92X. Also, FIG. 4 includes servo motor 95X mounted to punch base 91X and the lead screw 96X coupled to drive nut 97X mounted to punch carriage 92X.

Figure 6:
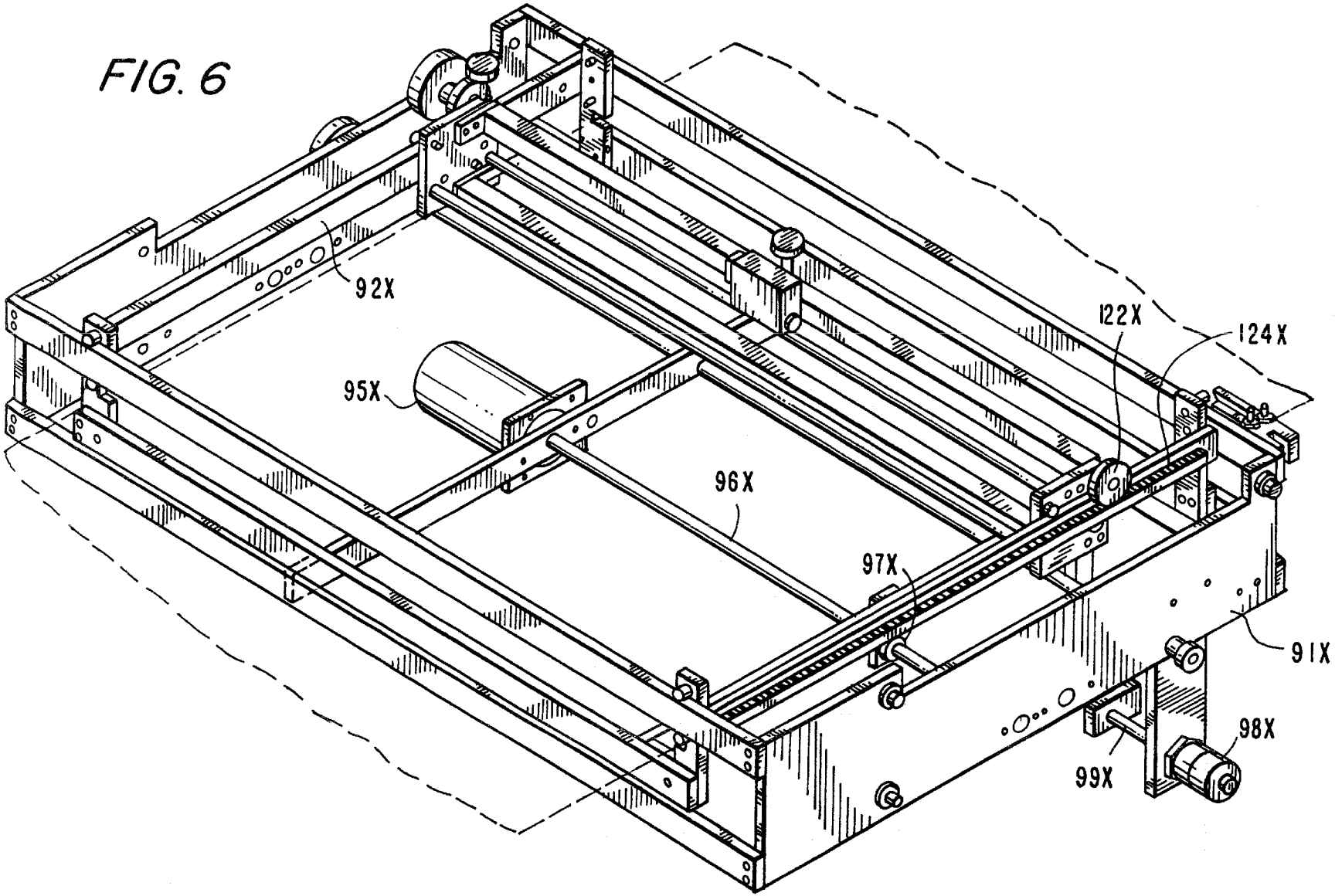
FIG. 6 is a view similar to FIG. 4 but rotated 90 degrees.
Figure 7:
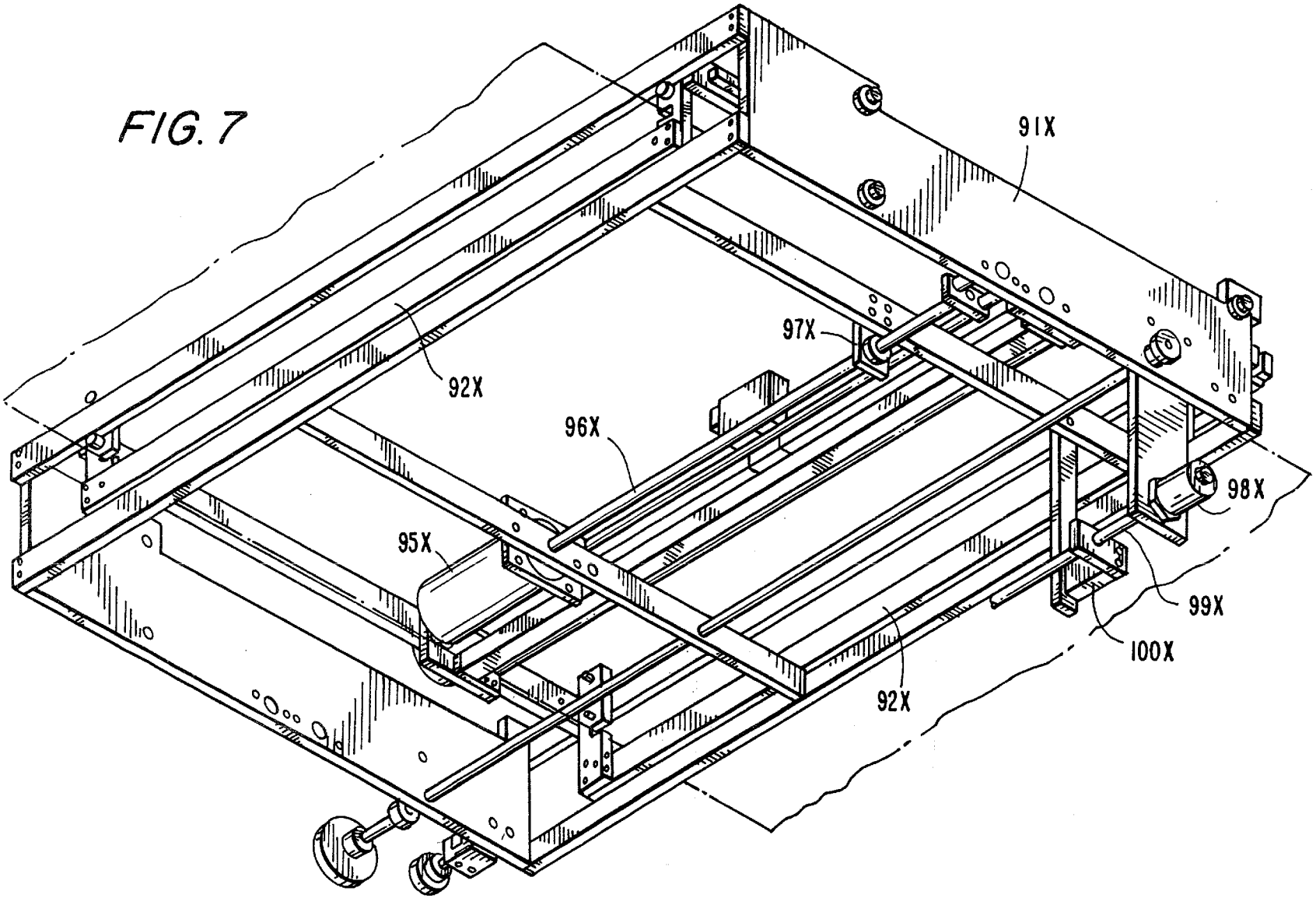
FIG. 7 is a bottom view of the apparatus shown in FIG. 6.

Punch carriage 92X is movable transversely per arrow 94X as described above, and is movable in the web direction per arrow 93X on rollers 122X operable with rack gear 124X. Not shown in these figures is the hole punch mechanism known in the prior art. FIGS. 6 and 7 correspond to FIG. 5 except that FIG. 6 is rotated 90 degrees and FIG. 7 shows a bottom view of FIG. 6. Corresponding components in FIGS. 4–7 are given the same reference numbers.

Figure 8:
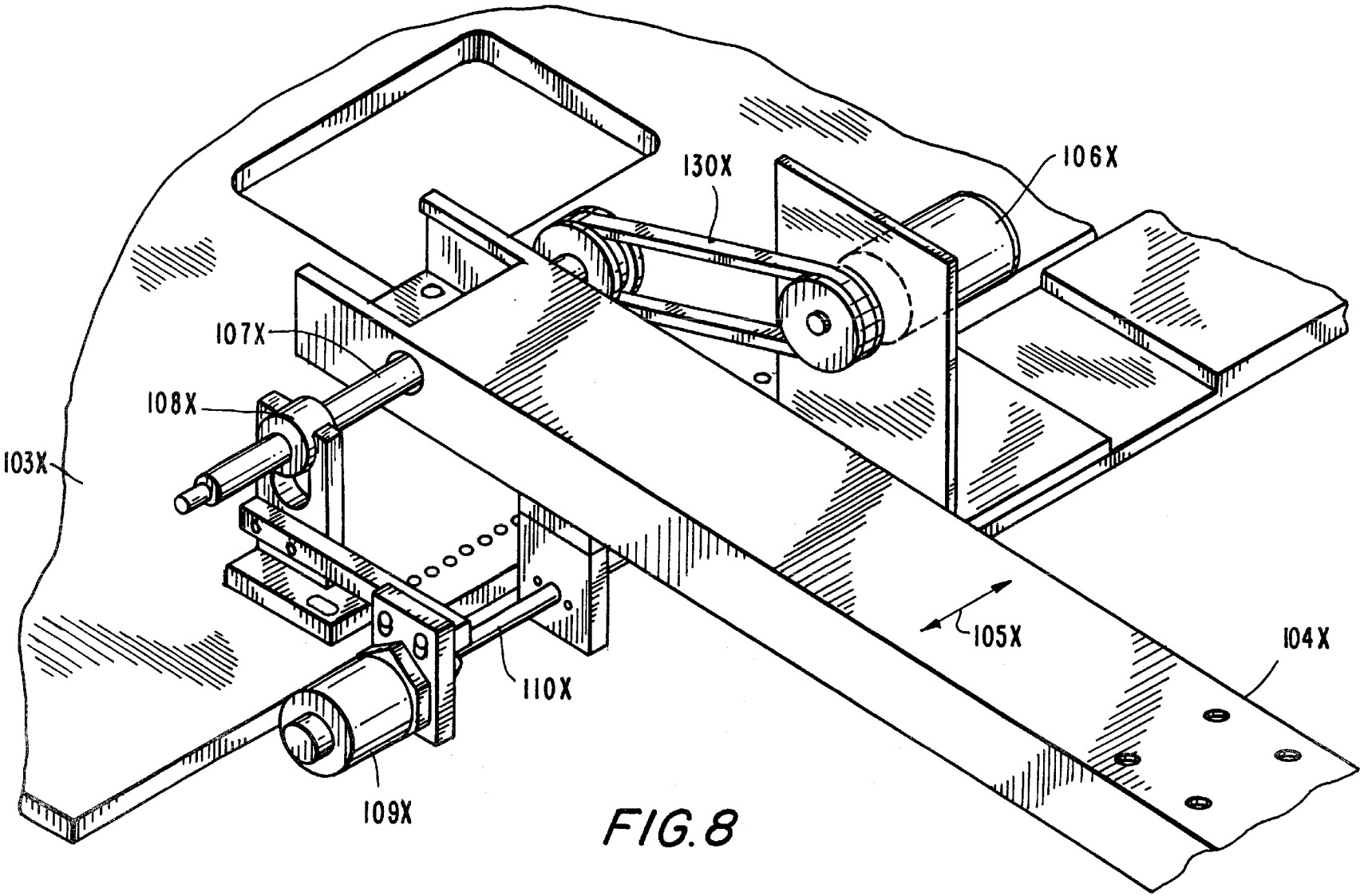
FIG. 8 is a fragmentary top perspective schematic view of the conveyor carriage at the stacking station of the new bag making machine of FIG. 3.
Figure 9:
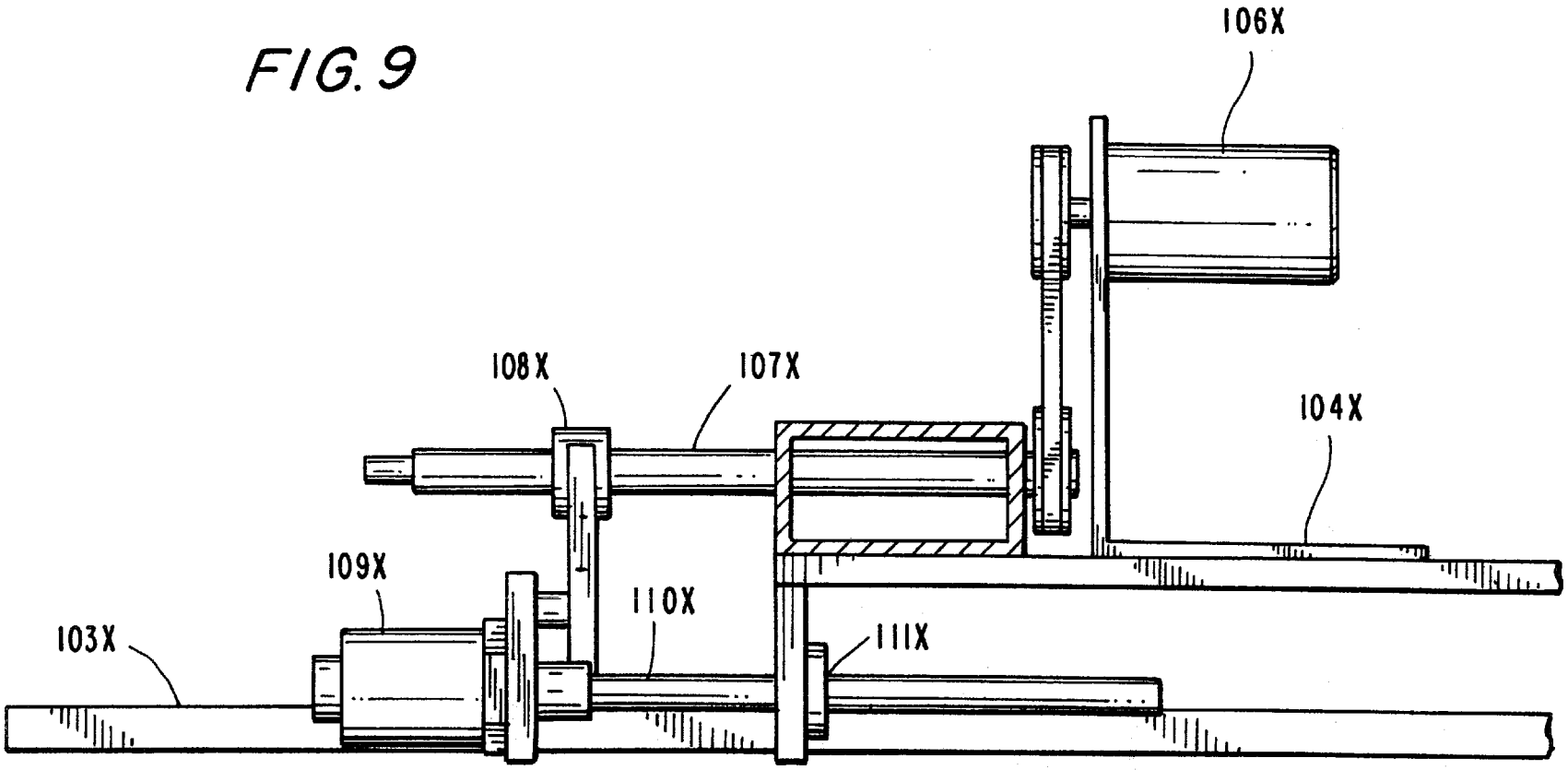
FIG. 9 is a fragmentary detail elevation view of the apparatus shown in FIG. 8.

FIGS. 8 and 9 illustrate a detailed structure of the conveyor carriage assembly shown schematically in FIG. 3. Thus, in FIGS. 8 and 9 there is a conveyor base 103X, movable conveyor carriage 105X which carries a conveyor belt (not shown) with its wicketing pins. Mounted to conveyor base 103X is servo motor 106X which is coupled via belt 130X to lead screw 107X engaged to drive nut 108X mounted to conveyer carriage 105X. Also mounted to conveyor base 103X is the sensor/transducer 109X whose shaft 110X extends through ring magnet 111X mounted to conveyor carriage 105X.

The sensor/transducers 98X and 109X are rod-type devices sold under the trade name Temposonic II which operate in a "resolution preferred mode". These sensor/transducers are calibrated to produce zero-10 V DC output when the rods 99X and 110X, respectively, of the sensor/transducers are moved axially in or out of their ring-type magnets 100X and 111X, respectively. In operation, if the output or command from the "reference" sensor/transducer 109X at the stacking station is equal to the output or feedback from the "follower" sensor/transducer 98X at the punch station, there will be no further output from the servo controller, meaning that the punch and conveyor carriages are in the same transverse alignment with respect to the web edge. If the web edge moves transversely in either direction beyond its allowable limits, the web sensor (not shown in FIGS. 4–9) reacts to such transverse shift by outputting a directional signal to the servo controller which directs servo motor 106X to move conveyor carriage 104X and its wicketing pins to compensate for such transverse web shift. From this movement sensor/transducer 109X outputs a proportional voltage to the servo controller which directs servo motor 95X to move punch carriage 92X to move transversely to be closer to the relative transverse position of the conveyor carriage. These outputs and feedbacks achieve alignment of the punch and stacking carriages such that the punched holes are delivered onto the wicketing pins.

Although the best mode contemplated for carrying out the present invention has been herein shown and described, it will be apparent that modifications and variations may be made without departing from what is regarded to be the subject matter of the invention as defined in the appended claims.

What is claimed is:

1. In a plastic bag making machine where a tubular web moves in a web feed direction past a web sensor and through a punch station, a sealing and cutting station, and a wicketer and stacking station, and where said web moving toward said punch station shifts beyond an allowable range in a transverse direction relative to said web feed direction affecting alignment of holes punched in said bags by a punch apparatus at said punch station with wicketing pins extending from wicketing stands on a conveyor at said stacking station, and where said punch apparatus is carried on a punch carriage movable in said transverse direction and said conveyor is carried on a conveyor carriage movable in said transverse direction, the improvement for aligning said punched holes in said bags with said wicketing pins at said stacking station, comprising a. a first servo motor for driving said punch carriage in said transverse direction, and a first sensor/transducer to measure any transverse direction movement of said punch carriage relative to a reference position, b. a second servo motor for driving said conveyor carriage in said transverse direction, and a second sensor/transducer to measure any transverse direction movement of said punch carriage relative to a reference position, c. a servo controller electrically coupled to said web sensor, to said first and second servo motors and to said first and second sensor/transducers, whereby said web sensor detects transverse direction shift of said web beyond said allowable range as said web nears said punch apparatus and outputs a directional signal indicating this transverse shift of said web to said servo controller, said servo controller outputs a directional command to said second servo motor to move said conveyor carriage and wicketing pins carried thereon in said transverse direction corresponding to that of the transversely shifted web, said second sensor/transducer measures the transverse movement of said conveyor carriage and outputs a directional signal corresponding to this moved position to said servo controller, said servo controller in response to said output from said second sensor/transducer outputs a directional command to said first servo motor to move said punch carriage in said transverse direction corresponding to said transversely moved position of said conveyor carriage, said first sensor/transducer measures the transverse movement of said conveyer carriage and outputs a directional signal corresponding to this moved position to said servo controller, and said servo controller compares said outputs from said first and second sensor/transducers and continues to output said directional commands to said first and second servo motors as long as both of said sensor/transducers indicate transversely moved positions of said conveyor and punch carriages that are not the same, and said servo controller ceases to output directional commands to said first and second servo motors when said first and second sensor/transducers output the same directional signals indicating that said conveyor carriage and said punch carriage have the same transversely moved positions and that said punched holes in said bags will be aligned with said wicketing pins.

2. A bag making machine according to claim 1 wherein said web sensor comprises a pair of cooperating elements spaced apart above and below said web near the edge thereof.

3. A bag making machine according to claim 1 wherein said first and second sensor/transducers each produce a voltage output proportional to the transverse movement of the conveyor and punch carriages respectively.

4. A bag making machine according to claim 1 further comprising a fixed base on which said conveyor and punch carriages are transversely movable, and wherein said first and second sensor/transducers each comprise a potentiometer with a linear extending rod mounted to said fixed base and a ring-type magnet carried by each of said conveyor and punch carriages respectively and through which one of said linear extending rods extends.

5. A bag making machine according to claim 1 wherein said conveyor carriage further comprises a drive nut fixed thereto and a lead screw coupled between said drive nut and said second servo motor.

6. A bag making machine according to claim 1 wherein said punch carriage further comprises a drive nut fixed thereto and a lead screw coupled between said drive nut and said first servo motor.

7. A bag making machine according to claim 1 wherein said punch carriage and said conveyor carriage are transversely moveable on a common frame.

8. A bag making machine according to claim 1 further comprising drive means for moving each of said punch and conveyor carriages independently of the other in said web feed direction.

9. A bag making machine according to claim 1 wherein said allowable range of transverse shift of said web is 0.1 inches and higher before said web sensor outputs a directional signal to said servo controller.

10. A bag making machine according to claim 1 wherein said punch apparatus comprises a pair of punch pins spaced apart and aligned in the web feed direction, and said wicketing pins on each of said wicketing stands are spaced apart and aligned similarly as said punch pins of said punch apparatus.

11. In a method of making plastic bags in a bag making machine which includes moving a tubular web in the web feed direction past a web sensor, a hole punch station which includes a punch apparatus carried on a punch carriage movable in a transverse direction relative to said web feed direction, a sealing and cutting station, and a wicketing and stacking station which includes wicketing pins on a conveyor carried on a conveyor carriage movable in said transverse direction, where said moving a web has shifted by an amount greater than an allowable range of shift in said transverse direction as said web nears said the hole punch station thus affecting alignment of punched holes in bags with wicketing pins when said bags are delivered from a wicketer to said wicketing pins at the stacking station, said method improving alignment of said punched holes in said bags onto said wicketing pins, comprising the steps:

a. providing a first servo motor for driving said punch carriage in said transverse direction, and a first sensor/transducer to measure any transverse direction movement of said punch carriage relative to a reference position, b. providing a second servo motor for driving said conveyor carriage in said transverse direction, and a second sensor/transducer to measure the transverse direction movement of said punch carriage relative to a reference position, c. providing a servo controller electrically coupled to said web sensor, to said servo motors and to said sensor/transducers, d. with said web sensor detecting said transverse direction shift of said web and outputting a directional signal indicating this shift to said servo controller, e. with the servo controller outputting a directional command to said second servo motor to start moving said conveyor carriage and wicketing pins carried thereon in said transverse direction corresponding to that of the transversely shifted web, f. with said second sensor/transducer measuring the transverse movement of said conveyor carriage and outputting a directional signal indicating said transversely moved position of said conveyor carriage to said servo controller, g. with said servo controller and in response to said communication from said second sensor/transducer directing said first servo motor to start moving said punch carriage in said transverse direction corresponding to said transversely moved position of said conveyor carriage, h. with said first sensor/transducer measuring the transverse movement of said conveyer carriage and outputting a directional signal indicating said transversely moved position of said conveyor carriage to said servo controller, and i. with said servo controller comparing said outputs of said first and second sensor/transducers and continuing to output directional commands to said first and second servo motors as long as both of said sensor/transducers indicate transversely moved positions of said conveyor and punch carriages that are not the same and ceasing to output directional commands to said first and second servo motors when said first and second sensor/transducer output the same directional signal indicating that said conveyor carriage and said punch carriage have the same transversely moved positions and that said punched holes in said bags will be aligned with said wicket pins.

12. A method according to claim 11 wherein said outputs from said first and second sensor/transducers comprise voltage outputs proportional to the transverse movement of the conveyor and punch carriage respectively.

13. A method according to claim 12 wherein each of said sensor/transducers comprises a potentiometer with a linear rod which extends through a ring-type magnet.

14. A bag making machine for making bags from a supply roll of tubular plastic web drawn through said machine in a web feed direction, comprising, a frame and mounted thereon a. a punch apparatus carried on a punch carriage moveable in a direction transverse to said web feed direction and arranged to punch at least one hole in said web for each of said bags, b. a cutting and sealing apparatus which forms and cuts said web into bags, c. a wicketer arranged downstream of said cutting and sealing apparatus, d. wicketing stands on a conveyor carried on a conveyor carriage moveable in said transverse direction and arranged downstream of said wicketer, each of said wicketing stands having at least one wicketing pin positioned and arranged to receive bags from said wicketer with said at least one punched hole of each bag landing onto said at least one wicketing pin, e. a web sensor which detects shift of said web in said transverse direction by an amount greater than an allowable range of shift as said portion of said web being sensed nears said punch apparatus, f. controller and drive means for operating said bag making machine, g. a first servo motor coupled to said punch carriage to move said carriage in said transverse direction, h. a first sensor/transducer coupled to said punch carriage to measure said transverse direction movement thereof relative to a reference position, i. a second servo motor coupled to said conveyor carriage to move said conveyor carriage in said transverse direction, j. a second sensor/transducer coupled to said conveyor carriage to measure said transverse direction movement thereof relative to a reference position, k. a servo controller electrically coupled to said first and second sensor/transducers and to said first and second servo motors and to said web sensor, whereby said web sensor outputs a directional signal indicating transverse shift of said web to said controller, said first and second sensor/transducers output to said servo controller directional signal indicating said transverse positional changes of said conveyor and punch carriages respectively, and said servo controller directs said first and second servo motors to transversely move said conveyor and punch carriages respectively toward similarly transversely displaced positions as long as said first and second sensor/transducers indicate transverse positional changes of said conveyor and punch carriages that are not the same, and said servo ceases to output directional commands to said first and second servo motors when said first and second sensor/transducer output the same directional signal indicating that said conveyor carriage and said punch carriage have the same transversely moved positions and that said punched holes in said bags will be aligned with said wicket pins.

* * * * *